US008973917B2

(12) United States Patent
Kallin et al.

(10) Patent No.: US 8,973,917 B2
(45) Date of Patent: Mar. 10, 2015

(54) DEPOSIT MODULE

(71) Applicant: NCR Corporation, Duluth, GA (US)

(72) Inventors: Fredik L. N. Kallin, Waterloo (CA); Anthony Boon, Kitchener (CA); Frank B. Dunn, Waterloo (CA)

(73) Assignee: NCR Corporation, Duluth, GA (US)

( * ) Notice: Subject to any disclaimer, the term of this patent is extended or adjusted under 35 U.S.C. 154(b) by 0 days.

(21) Appl. No.: 13/663,947

(22) Filed: Oct. 30, 2012

(65) Prior Publication Data

US 2014/0117614 A1 May 1, 2014

(51) Int. Cl.

| | |
|---|---|
| ***B65H 5/00*** | (2006.01) |
| ***G07F 19/00*** | (2006.01) |
| ***G07D 11/00*** | (2006.01) |

(52) U.S. Cl.

CPC ..... *G07F 19/202* (2013.01); *G07D 11/0027* (2013.01); *G07D 11/0033* (2013.01)

USPC ..... 271/225; 271/185

(58) Field of Classification Search

CPC ..... B65H 29/125; B65H 2301/33216; B65H 2301/33222; B65H 2301/341

USPC ..... 271/225, 273, 184, 185

See application file for complete search history.

(56) References Cited

U.S. PATENT DOCUMENTS

| | | | | |
|---|---|---|---|---|
| 4,343,582 | A | 8/1982 | Lundblad et al. | |
| 4,591,046 | A * | 5/1986 | Toste et al. | 198/457.07 |
| 4,979,730 | A * | 12/1990 | Holbrook et al. | 271/265.02 |
| 6,343,686 | B1 * | 2/2002 | Whiting et al. | 198/379 |
| 6,877,741 | B2 * | 4/2005 | Polidoro et al. | 271/251 |
| 8,061,709 | B2 * | 11/2011 | Lewalski et al. | 271/225 |
| 2010/0090395 | A1 * | 4/2010 | Lewalski et al. | 271/248 |

FOREIGN PATENT DOCUMENTS

| | | |
|---|---|---|
| EP | 1 139 303 | 10/2001 |
| WO | 00/52649 | 9/2000 |

* cited by examiner

*Primary Examiner* — Michael McCullough
(74) *Attorney, Agent, or Firm* — Joseph P. Mehrle

(57) ABSTRACT

A Self-Service Terminal (SST) or deposit module for an SST and a method of use are disclosed for transporting an item of media along a transport path. The SST includes a guide surface comprising a first region in which an item of media is transported in a first orientation with respect to a respective direction of transport, and a further region in which an item of media is transported in a further orientation with respect to a respective direction of transport. The SST also includes a re-orientation module that transports an item of media between the first and further regions and rotates an item of media received at a one of the first and further regions into an orientation associated with a remainder one of the first and further regions.

12 Claims, 12 Drawing Sheets

DEPOSIT MODULE

FIELD OF THE INVENTION

The present invention relates to a deposit module for use in a Self-Service Terminal (SST) and a method of operating a deposit module.

Various types of Self-Service Terminal (SST) are known in which items of media can be dispensed and/or deposited. For example, an SST may be an Automated Teller Machine (ATM), kiosk, or the like. Such terminals are used to store items of media as sheet-like elements and dispense these from time to time as requested by a user. Certain SSTs also enable users to deposit such items of media from time to time. The items of media themselves, which can be currency notes, checks, giros, lottery tickets, envelopes or the like, are typically shaped in a non-symmetric fashion. That is to say, for example, currency notes are typically rectangular in shape having two parallel spaced apart long edges and two parallel spaced apart short edges. In certain SSTs or certain modules within certain SSTs the items of media must be presented and processed in a specific orientation. For example, in an ATM, cash dispensers and cash and check acceptors transport and store their documents in different orientations approximately 90° different to each other. This makes them and bin modules and cassettes used in such terminals/modules incompatible with each other. Cash dispensers conventionally move cash through their modules long edge first. By contrast, some cash and check acceptors move documents short edge first. This makes for a considerable degree of incompatibility between differing terminals and modules which increases cost and reduces a user experience at the terminal since different slots having different sizes to receive or dispense items of media in different orientations must be provided in a front panel of the ATM.

SUMMARY OF THE INVENTION

It is an aim of the present invention to at least partly mitigate the above-mentioned problems.

It is an aim of certain embodiments of the present invention to make it possible to deposit items of media such as currency notes long edge first or short edge first at a user interface of an SST and for those items to be rotated internally within the terminal so that they can subsequently be transported and processed in a long edge first orientation.

It is an aim of certain embodiments of the present invention to enable items of media, such as currency notes, to be presented by a user long edge first and for these to be rotated within a terminal so that they can subsequently be transported and/or processed short edge first.

It is an aim of certain embodiments of the present invention to enable items of media, such as currency notes, to be presented by a user at an SST in multiple possible orientations. Thereafter, items of media are processed internally within the SST with each individual item being automatically orientated into a required orientation appropriate to a process that is to be applied to that item. According to a first aspect of the present invention there is provided a deposit module, comprising:

a first region in which a media item is transported in a first orientation;

a further region in which the media item is transported in a further orientation; and a re-orientation device that (i) transports the media item between the first and further regions and (ii) rotates the media item between the first and further orientations.

Aptly, the re-orientation device comprises:

a rotatable item guide rotatable by a drive shaft; and at least one clamping element that selectively clamps an item of media to move with the item guide, and automatically releases a clamped item from the item guide, as the item guide rotates to a pre-determined location.

Aptly, the re-orientation device further comprises:

a housing comprising a cam surface; wherein the clamping element comprises an abutment surface that engages with the cam surface to selectively clamp and release an item of media at pre-determined locations as the clamping element rotates with respect to the cam surface.

Aptly, the re-orientation device further comprises:

a base comprising a lower bearing race;

a retainer comprising a plurality of rollers; and an upper bearing race on a lower surface of the item guide.

Aptly, the deposit module further comprises:

a drive belt that connects the drive shaft to a motor;

a timing disc carried on the drive shaft and comprising at least one mark; and at least one sensor that determines a location of each mark.

Aptly, the deposit module further comprises a first roller that selectively drives an item of media along the first region towards and/or away from the re-orientation device.

Aptly, the deposit module further comprises a solenoid that selectively locates said first roller in an engaged or disengaged mode of operation.

Aptly, the deposit module further comprises a further roller that selectively drives an item of media along said further region towards and/or away from the re-orientation device.

Aptly, the deposit module further comprises a solenoid that selectively locates said further roller in an engaged or disengaged mode of operation.

Aptly, the transport path is bi-directional.

Aptly, the first orientation is rotated substantially 90° with respect to the further orientation.

Aptly, the deposit module further comprises a first axis of transport associated with the first region is substantially parallel to and spaced apart from a further axis of transport associated with the further region.

Aptly, the deposit module is an Automated Teller Machine (ATM) and each item of media is a currency note or check.

According to a second aspect of the present invention there is provided a Self-Service Terminal (SST) incorporating the deposit module of the first aspect of the invention.

The SST may comprise an ATM.

According to a third aspect of the present invention there is provided a method of transporting at least one item of media along a transport path in a deposit module, comprising the steps of:

transporting an item of media along a first region or a further region of a guide surface;

transporting the item of media from a one of the first or further regions to a remainder one of the first or further regions via a re-orientation device; and transporting the item of media along a remainder one region; whereby as said item of media is transported between the first and further regions, an item of media is re-orientated from an orientation associated with said a one region to an orientation associated with said remainder one region.

According to a fourth aspect of the present invention there is provided a method of re-orientating an item of media in a deposit module, comprising the steps of:

transporting an item of media, in a first orientation, to a turntable;

rotating the turntable to re-orientate the item of media; and transporting the re-orientated item of media from the turntable.

According to a fifth aspect of the present invention there is provided a Self-Service Terminal (SST) for transporting at least one item of media along a transport path, comprising:

at least one guide surface comprising a first region in which an item of media is transported in a first orientation with respect to a respective direction of transport, and a further region in which an item of media is transported in a further orientation with respect to a respective direction of transport; and a re-orientation module that transports an item of media between the first and further regions and rotates an item of media received at a one of the first and further regions into an orientation associated with a remainder one of the first and further regions.

According to a sixth aspect of the present invention there is provided a method of transporting at least one item of media along a transport path in a Self-Service Terminal (SST), comprising the steps of:

transporting an item of media along a first region or a further region of a guide surface;

transporting the item of media from a one of the first or further regions to a remainder one of the first or further regions via a re-orientation module; and transporting the item of media along a remainder one region; whereby as said item of media is transported between the first and further regions, an item of media is re-orientated from an orientation associated with said a one region to an orientation associated with said remainder one region.

According to a seventh aspect of the present invention there is provided a method of re-orientating an item of media in a Self-Service Terminal (SST), comprising the steps of:

transporting an item of media, in a first orientation, to a turntable;

rotating the turntable to re-orientate the item of media; and transporting the re-orientated item of media from the turntable.

The turntable may rotate in a plane parallel to an entrance slot of the SST. According to an eighth aspect of the present invention there is provided a deposit module, for transporting at least one item of media along a transport path, comprising:

at least one guide surface comprising a first region in which an item of media is transported in a first orientation with respect to a respective direction of transport, and a further region in which an item of media is transported in a further orientation with respect to a respective direction of transport; and a re-orientation module that transports an item of media between the first and further regions and rotates an item of media received at a one of the first and further regions into an orientation associated with a remainder one of the first and further regions.

Certain embodiments of the present invention enable a transported document to be rotated through about around 90° or more, for example, from a short edge orientation to a long edge orientation within an SST or deposit module, making it possible to transport items into a first region where items must travel long edge first from a source of items which provides items in a short edge first configuration.

Certain embodiments of the present invention enable items to be returned from a long edge first source to a short edge first target location.

Certain embodiments of the present invention rotate documents being transported through about around 90°, for example, from short edge to long edge first orientations.

Certain embodiments of the present invention enable items of media to be automatically rotated to a desired onward orientation appropriate to a pathway which is to be followed subsequent to the orientation step. In this way multiple input paths and multiple output paths can be interconnected by a common orientation device. The transport paths may be spaced apart radially about the re-orientation device and the items of media are rotated through an appropriate angle of rotation for onward transport.

BRIEF DESCRIPTION OF DRAWINGS

Embodiments of the present invention will now be described hereinafter, by way of example only, with reference to the accompanying drawings in which.

DESCRIPTION OF EMBODIMENTS

Figure 1A:
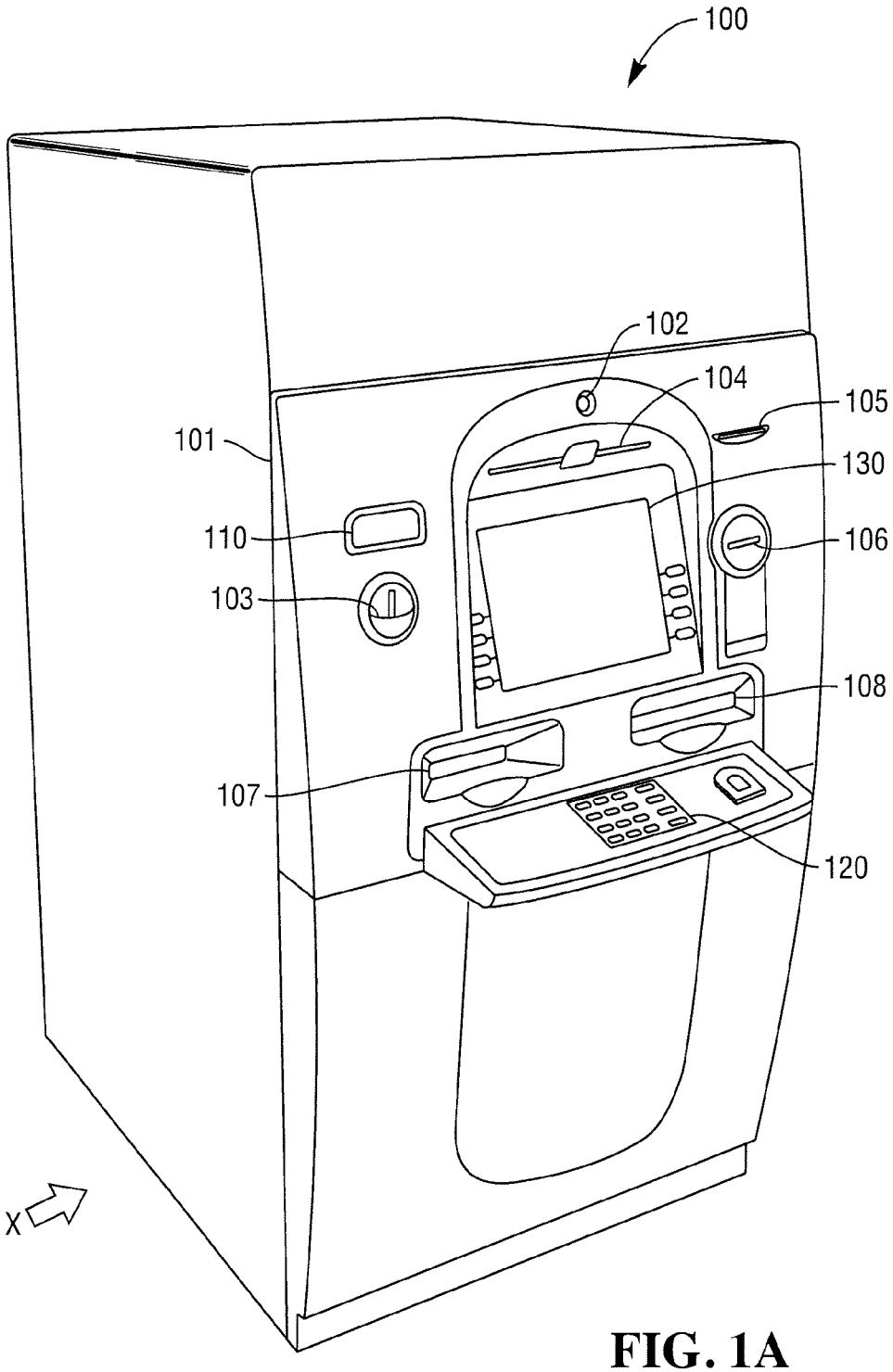
FIGS. 1A-1B illustrate a Self-Service Terminal (SST) in the form of an Automated Teller Machine (ATM)

In the drawings like reference numerals refer to like parts.

FIG. 1A illustrates a self-service dispense and deposit terminal in the form of an Automated Teller Machine (ATM) 100. It will be appreciated that certain embodiments of the present invention are applicable to a wide variety of terminals in which items of media such as checks and/or currency notes and/or giros and/or lottery tickets and/or envelopes and/or other such flexible sheet-like items of media are to be transported prior to dispensation or after deposit. The type of terminal will of course be appropriate for the type of items of media being transported.

As illustrated in FIG. 1A, the ATM 100 includes a fascia 101 coupled to a chassis (not shown). The fascia 101 defines an aperture 102 through which a camera (not shown) images a customer of the ATM 100. The fascia 101 also defines a number of slots for receiving and dispensing media items and a tray 103 into which coins can be dispensed. The slots include a statement output slot 104, a receipt slot 105, a card reader slot 106, a cash dispense slot 107, a cash and check deposit slot 108 and a branding badge 110. The slots and tray are arranged such that the slots and tray align with corresponding ATM modules mounted within the chassis of the ATM.

The fascia 101 provides a user interface for allowing an ATM customer to execute a transaction. The fascia 101 includes an encrypting keyboard 120 for allowing an ATM customer to enter transaction details. A display 130 is provided for presenting screens to an ATM customer.

Within the chassis of the ATM 100 it will be understood that items of media must be transported from time to time from one location to another. The pathway taken by any particular item of media is dependent upon an operation being carried out at the ATM and may also be dependent upon other factors such as whether a user of the ATM is authorized and/or whether an item of media being transported satisfies certain pre-determined criteria.

Figure 1B:
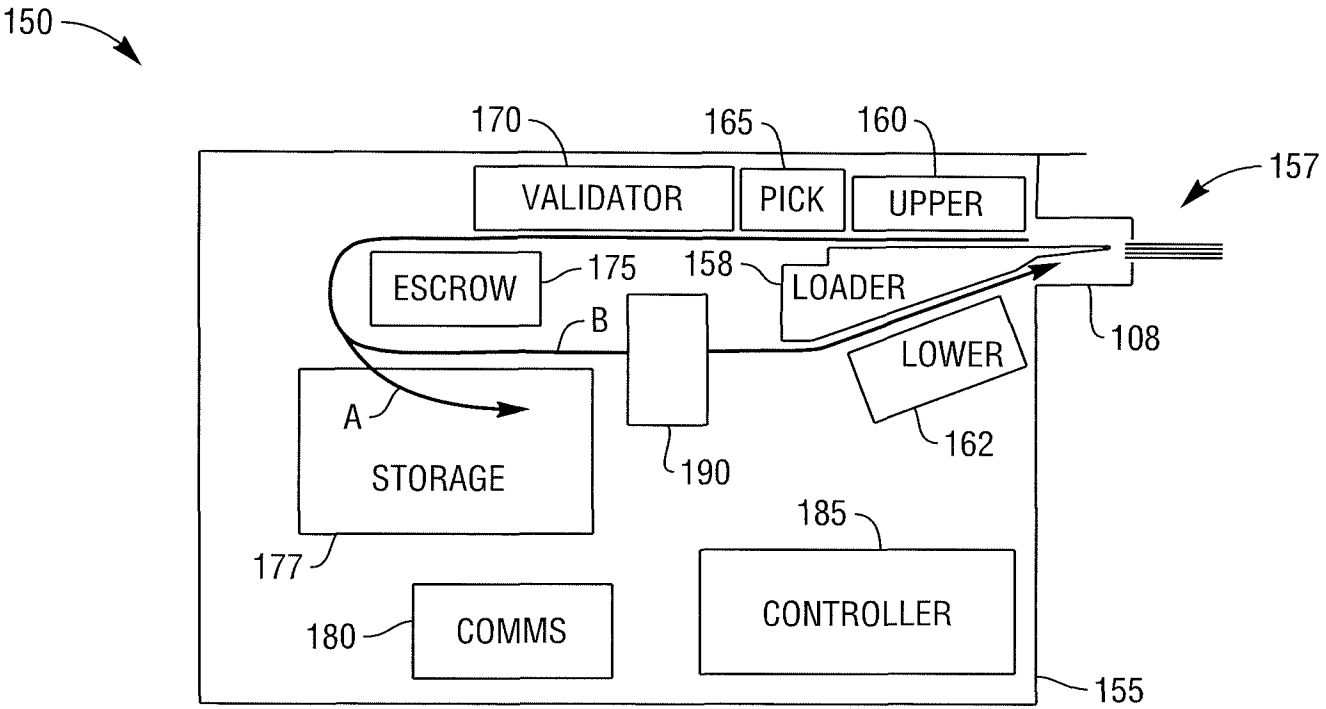

A media item depository 150 is shown in more detail in FIG. 1B. The deposit module 150 includes a chassis 155 onto which various parts are mounted. The depository 150 further includes a bunch deposit slot 108 at which a customer (not shown) can introduce a bunch 157 of currency notes or other such items of media (such as checks). This enables the sheet items of media to be deposited by a customer. A bunch loader 158 co-operates with an upper loading unit 160 and a lower dispatch unit 162. These co-operate to receive the bunch of items of media and move them to a pick unit 165 or return them to a customer via slot 108 respectively. The pick unit 165 is aligned with the bunch loader 158 for removing individual sheets from the bunch of sheets 157. A sheet validator 170 determines whether the items of media are valid. An escrow 175 is provided for temporarily storing validated sheets until a customer confirms they wish to complete a transaction. A storage compartment 177 is provided as well as a communication circuit board 180 for communicating with the self-service terminal 100 into which the depository 150 may be installed. An on-board controller 185 is provided for controlling the operation of the depository 150.

The depository 150 includes a plurality of transport units only some of which are described herein. An upper sheet transport section 160 is located above the bunch loader 158 and adjacent to the picker 165. A lower sheet transport section 162 is located beneath the bunch loader 158 and near the bunch deposit slot 108.

The bunch loader 158 is used to transport deposited currency notes from the bunch deposit slot 108 to the pick unit 165.

There are two different routes that can be taken by an item of media that is inserted into the depository 150. A first route is shown by arrow A and involves the sheet media item being picked from the bunch of sheets 157, transported to the picker unit 165, moved past the validator 170 to be identified and validated, placed in the escrow 175 and from the escrow 175 transported into the storage compartment 177.

The second optional route is shown by the arrow B and involves the sheet item being picked from the bunch of sheets 157, transported to the picker unit 165, moved past the validator 170 to be identified and validated, placed in the escrow 175 and from the escrow 175 returned to the customer via a rebunching unit 190 and via the loading unit 158 and lower transport section 162.

As will be understood by those skilled in the art, whether a sheet item is stored (that is to say, follows the route shown by arrow A) or returned to a customer (that is to say, follows a path shown by arrow B) depends on a number of factors, such as whether the sheet is recognized, whether a sheet is validated and/or whether a customer cancels or confirms a transaction or the like.

Figure 2:
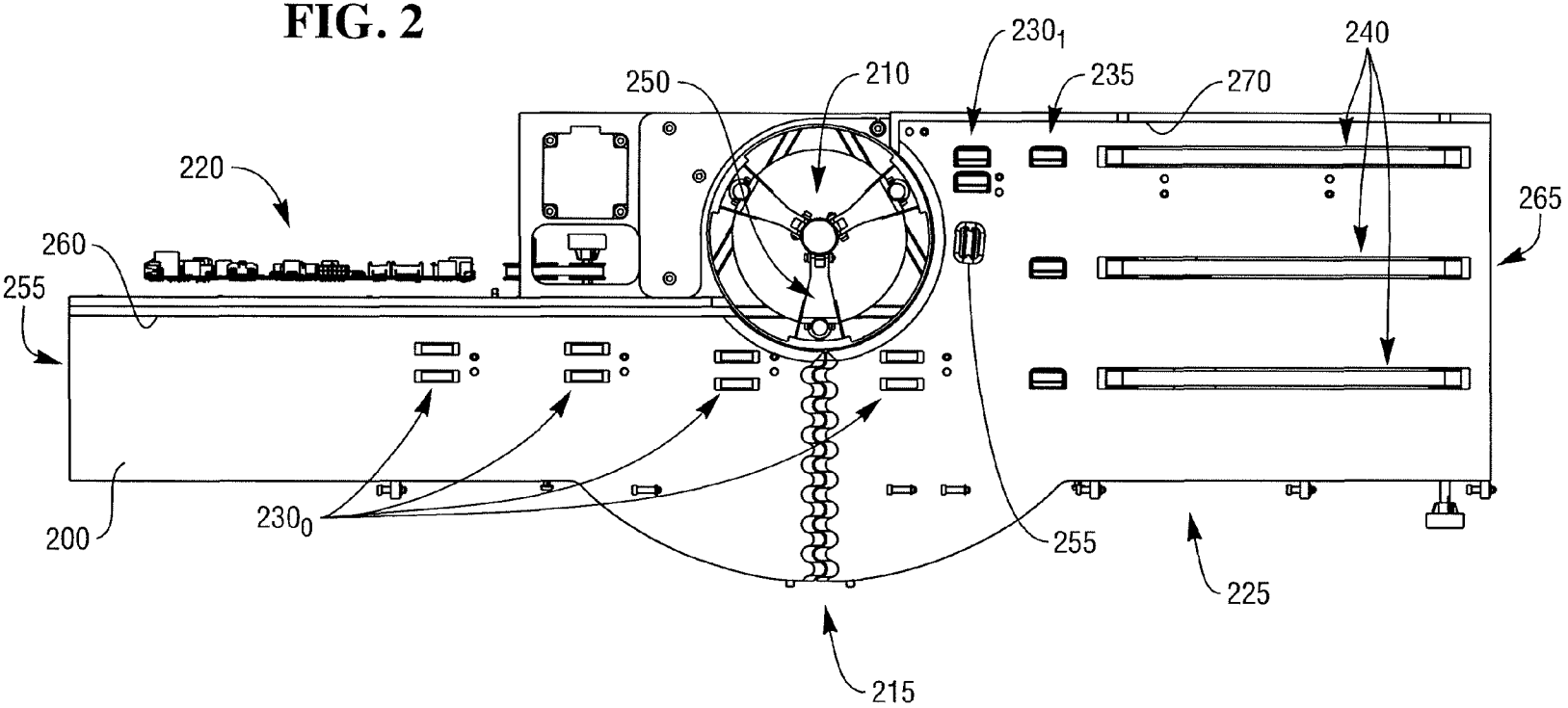
FIG. 2 illustrates a guide surface including driven rollers and drive belts according to an embodiment of the present invention which defines a region of a transport path within a deposit module in the ATM.

FIG. 2 illustrates a guide surface 200 along which items of media are transported in the deposit module 150. A re-orientation device 210 in the form of a turntable is located in an intermediate region 215 of the guide surface. To the left hand side (in FIG. 2) of the guide surface 200 is a first region 220 of the guide surface. To the right hand side of FIG. 2 is a further region 225 of the guide surface 200. The first region 220, intermediate region 215 and further region 225 of the guide surface 200 define a bi-directional transport path between the left and right hand sides of the guide surface 200. It will be understood that uni-directional transport of items of media can be envisaged according to certain other embodiments of the present invention.

The turntable 210 and guide surface 200 may be used in any module of an SST. For example, in the illustrated ATM 100 certain embodiments of the present invention may be utilized in deposit modules and/or dispense modules and/or recycle modules. Certain embodiments of the present invention can thus be utilized to change an orientation of a document/item being processed wherever desired. This may be used to increase storage capacity of certain modules. For example, when documents are deposited in a short edge orientation there may be room for only two stacks of items in the depth of a storage container. By contrast, if those items can be rotated 90° then there may be room for four or more stacks.

The guide surface 200 provides a support surface that supports and guides items of media as they are transported. Rollers are driven to rotate to move the items of media on the guide surface. The rollers may be arranged in pairs as per the pairs of rollers $\mathbf{230}_0$, $\mathbf{230}_1$ shown in FIG. 2 or as single rollers 235. As is also shown in FIG. 2, an arrangement of parallel spaced apart driven endless belts 240 can also be utilized to move items of media along on the guide surface 200. Various combinations of rollers and belts can of course be envisaged. A clamping point 250 which also operates as a release point depending upon a direction of transport, is provided when the turntable is at one position of rotation. The turntable rotates in a selective controlled manner, as will be described hereinafter in more detail, to locate items of media between this clamping position and a further clamping position (not shown in FIG. 2) where the items of media can again be released or picked up.

FIG. 2 also helps illustrate a position of a deskew drive roller 255 which is driven selectively and used to align a currency note being transported in the left to right direction subsequent to re-orientation by the turntable-like mechanism. Items input at a first end 255 of the lower guide surface 200 ride along on an upstanding edge 260 of the guide which helps keep the item correctly aligned. Items leaving the lower guide at a further end 265 ride along an upstanding edge 270 which helps align the item.

Figure 3:
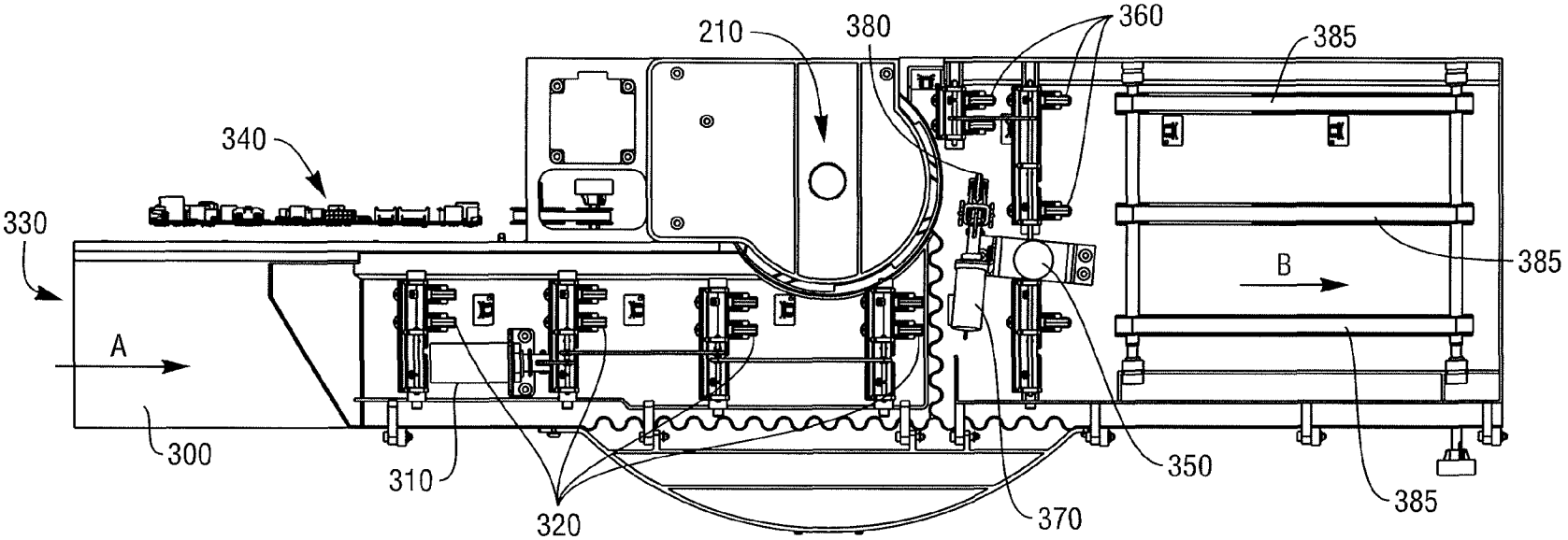
FIG. 3 illustrates the activation of transport idlers and guide belts in an upper guide that move items of media along the transport path.

FIG. 3 helps illustrate an upper guide surface 300 which is opposed to and spaced apart from the lower guide surface 200 shown in FIG. 2. FIG. 3 helps illustrate how a drive solenoid 310 is connected to pairs of idlers 320 via a connecting pin network. With the drive solenoid 310 driven into an engaged mode of operation, the idlers are extended downwardly from a lower surface of the upper guide towards the driven rollers which extend through the lower guide surface. With the solenoid driven into a disengaged mode of operation the idlers 320 are withdrawn from the guide surface and thus the driven rollers below.

FIG. 3 also helps illustrate the movement of items of media in a left-to-right mode of operation. In such a mode, items of media are introduced at a first end 330 of the guide surface 300 in a direction of transport illustrated by arrow A. The driven rollers $\mathbf{230}_0$ and opposed idle rollers move the item of media, such as a currency note, from left to right with an edge of a currency note being located against an abutment surface 260 of the lower guide surface 200 and moved past a circuit board 340 adjacent to the upper guide surface 300. The items of media eventually reach the turntable 210 which acts as a re-orientation module and which picks up the items of media and rotates them through the intermediate region 215 into a further region 225 of the transport pathway. Here a further solenoid 350 is used to engage or disengage another set of idlers 360 from the drive rollers $\mathbf{230}_1$, 235 in the lower guide surface. A deskew solenoid 370 is activated to release a deskew idler 380. With the deskew solenoid 370 activated the roller comes into contact with an item of media as it is released from the re-orientation module. The document is caught between the deskew drive roller and an idler which results in the document being moved towards the track base edge. The document is thus forced to align with the track base. Subsequent to deskewing the deskew drive roller is disengaged. The document is thereafter transported by the rollers/idlers and flat belts, long edge first. Items of media are then transported away from the turntable 210 along a direction of transport illustrated by arrow B by drive belts 240 in the lower guide surface and opposed guide belts 385 in the upper guide surface to a further end 390 of the guide surface 300.

Figure 4:
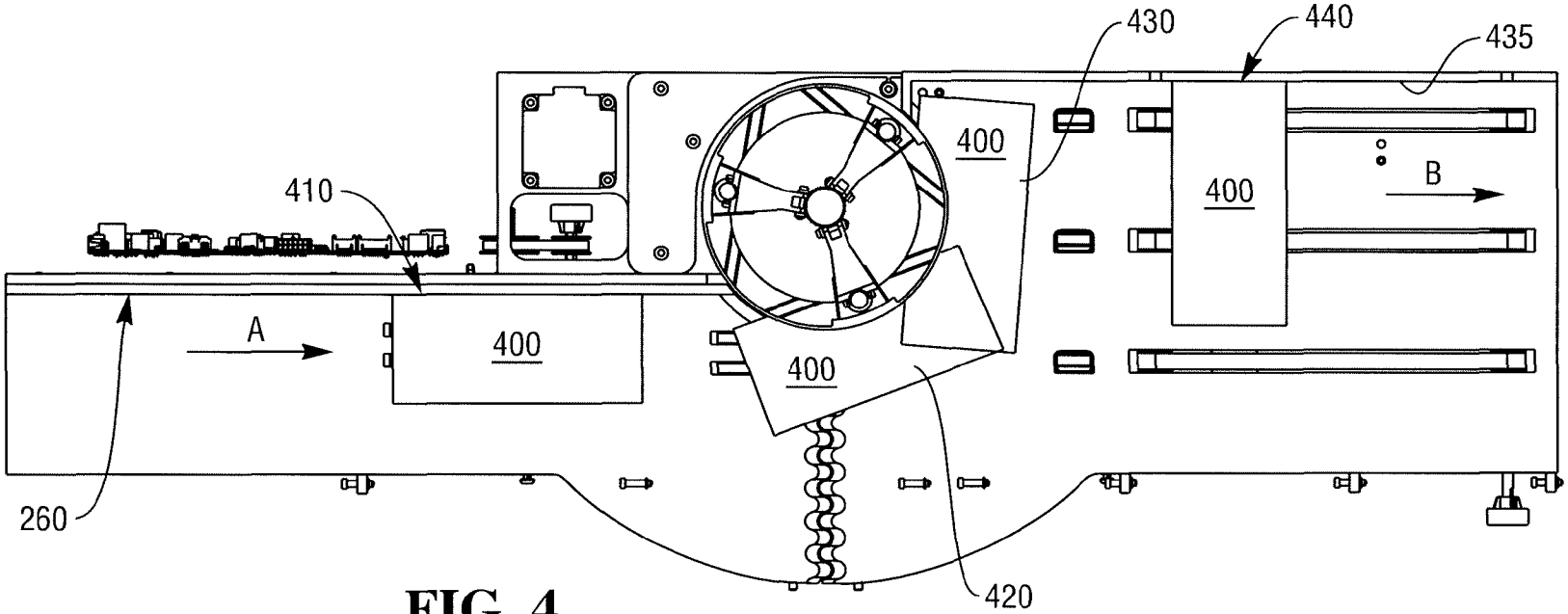
FIG. 4 illustrates an item of media at various stages as it is transported along the transport path in different orientations.

FIG. 4 illustrates motion of an item of media 400 in various positions along a transport path in the direction of transport illustrated in FIG. 3. The first position of the currency note 400 shown in FIG. 4 is the position 410 illustrated to the left of the turntable 210. In this position, the currency note 400 moves in a respective direction of transport A with an edge of the currency note 400 abutting the abutment surface 260 which helps locate the currency note as it is transported. The currency note is moved by virtue of the opposed driven rollers 230 and idlers until it reaches the clamping position 250. At this stage, a clamping mechanism on the turntable closes to releasably secure the item of media to a rotating element of the turntable. As illustrated in FIG. 4, the turntable is then rotated in a counter-clockwise direction about a central axis of rotation. A second position 420, in which the turntable has begun to turn from the clamping/release position 250 carrying a currency note with it, is illustrated in FIG. 4. The rotating parts of the turntable-like mechanism 210 continue to turn in a counter-clockwise fashion until the item of media/currency note 400 reaches a further position 430 illustrated in FIG. 4. Shortly thereafter, the turntable element operates in such a way so as to release the item of media. An edge of the currency note 400 thereafter becomes aligned with a further abutment surface 270 in the further region 225 of the transport pathway by operation of the deskew motor and roller. It will be appreciated that during this process the currency note 400 has been re-orientated from a short edge first orientation shown at the first position 410 to a long edge first orientation shown in a fourth position 440 shown in FIG. 4 with respect to a particular direction of transport. Thereafter, the currency note 400 is driven by the drive rollers and drive belts along a respective direction of transport B. It will be appreciated that the direction of transport illustrated by arrow A and arrow B are substantially parallel but spaced apart. For bi-directional transport a further deskew motor and roller can optionally be included to urge a currency note against the abutment surface 320.

Figure 5:
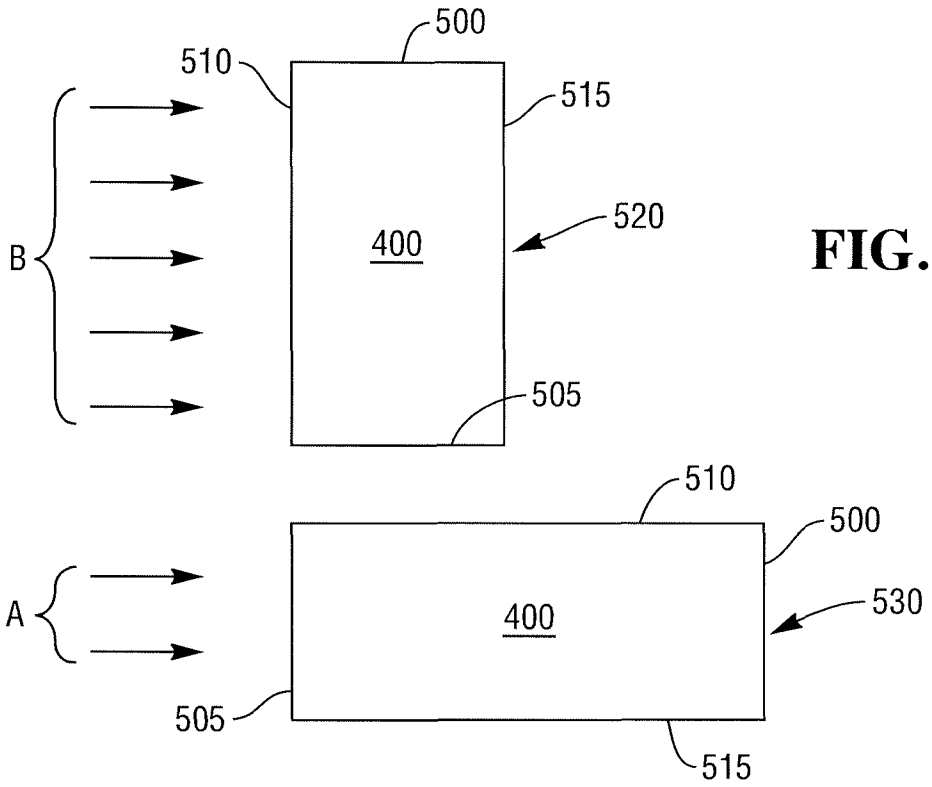
FIG. 5 illustrates two different orientations of an item of media.

FIG. 5 illustrates two different orientations of a currency note 400. Each currency note has a first short edge 500 and a further short edge 505. The short edges are substantially parallel and spaced apart. Each currency note 400 also includes a first long edge 510 and a further long edge 515. Each long edge is substantially parallel and spaced apart from the other. Each currency note 400 is thus substantially rectangular in shape. In a first orientation 520 a longitudinal axis of the currency note is substantially perpendicular to a direction of transport B. This is described as a long edge first orientation 520. In a further orientation 530, a longitudinal axis of the currency note is substantially parallel with a direction of transport. This is described as a short edge first orientation. Items of media having other shapes and thus different possible orientations with respect to a direction of transport can of course be utilized according to certain other embodiments of the present invention.

Figure 6:
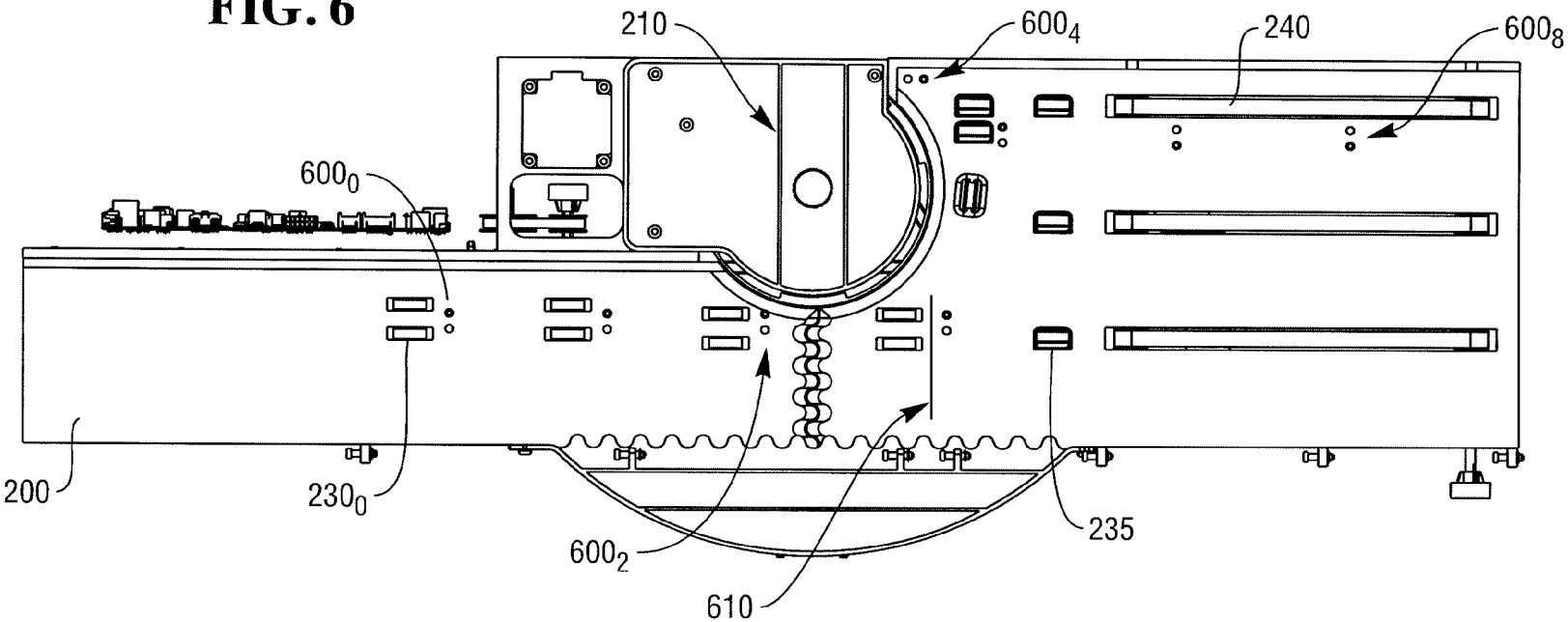
FIG. 6 illustrates the location of sensors used to detect when an item of media is at a respective pre-determined location along the transport path.

FIG. 6 illustrates how motion of currency notes on the guide surface 200 are monitored and how the arrival of a currency note at a pre-determined position may be detected. An array of sensors $\mathbf{600}_{0\ldots8}$ are illustrated in FIG. 6. Each array is utilized to monitor when a leading edge of a currency note reaches a pre-determined position 610 with respect to that sensor array. For example, each sensor array can be a reflectance or transmittance sensor. When a signal from a respective sensor array 600 changes state, this indicates that a leading edge of a currency note has reached a particular position on the guide surface 200. This is utilized to control driving of rollers, the turntable 210 and/or the drive belts 240. It will be appreciated that other detection mechanisms can be utilized and could, for example, be utilized to detect a trailing edge of a currency note providing that a shape and size of the item of media being transported is pre-known or previously determined.

The document is thus transported short edge first, left to right in FIG. 6 (or right to left if bi-directional transport is envisaged) with a bottom edge aligned to an abutment surface on the base. The leading and trailing edge of the document is recorded by sensors for document tracking and timing component actuation within the module. For example, when an item of media lead edge passes the sensor $\mathbf{600}_2$ the document can be slowed down until its lead edge reaches the pre-determined identification location 610 detected by the sensors $\mathbf{600}_3$. At this point, the item of media is within the turntable mechanism. Identifying the presence of the item of media at this location triggers a speeding up in rotational speed of the turntable (which is otherwise stationary until the continually running transport system delivers a next item of media at the pre-determined location 610) to help match the item velocity to the turntable speed. Slowing the transport velocity prior to clamping a currency note helps avoid misalignment and jams.

Figure 7:
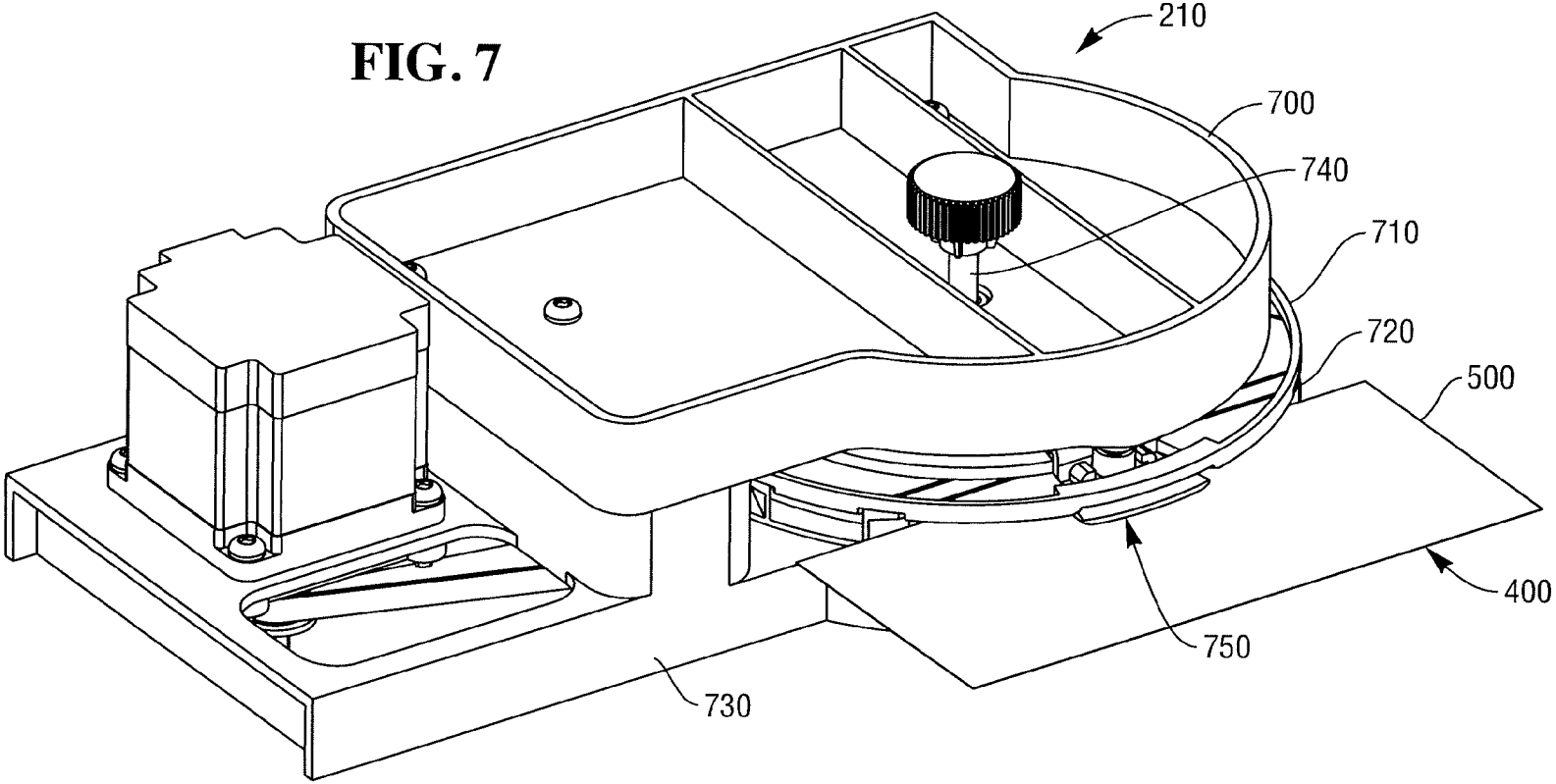
FIG. 7 illustrates how an item of media is clamped to a rotatable turntable within the deposit module.

FIG. 7 illustrates a currency note 400 presented at a clamping position 250 corresponding to a leading edge 500 being detected at the identification position 610 on the guide surface. The re-orientation module 210 includes an upper housing 700, an upper rotating guide 710, a lower rotating guide 720 and a base 730. The base 730 and upper housing 700 are fixed in position rigidly with respect to the guide surface 200. The rotating upper and lower guides 710, 720 are rotated by a drive shaft 740. One of three clamps 750 carried by the rotating upper and lower guide is utilized to clamp the currency note 400 to move with the rotating upper and lower guides so that the currency note 400 moves with the guides as they are rotated.

Figure 8:
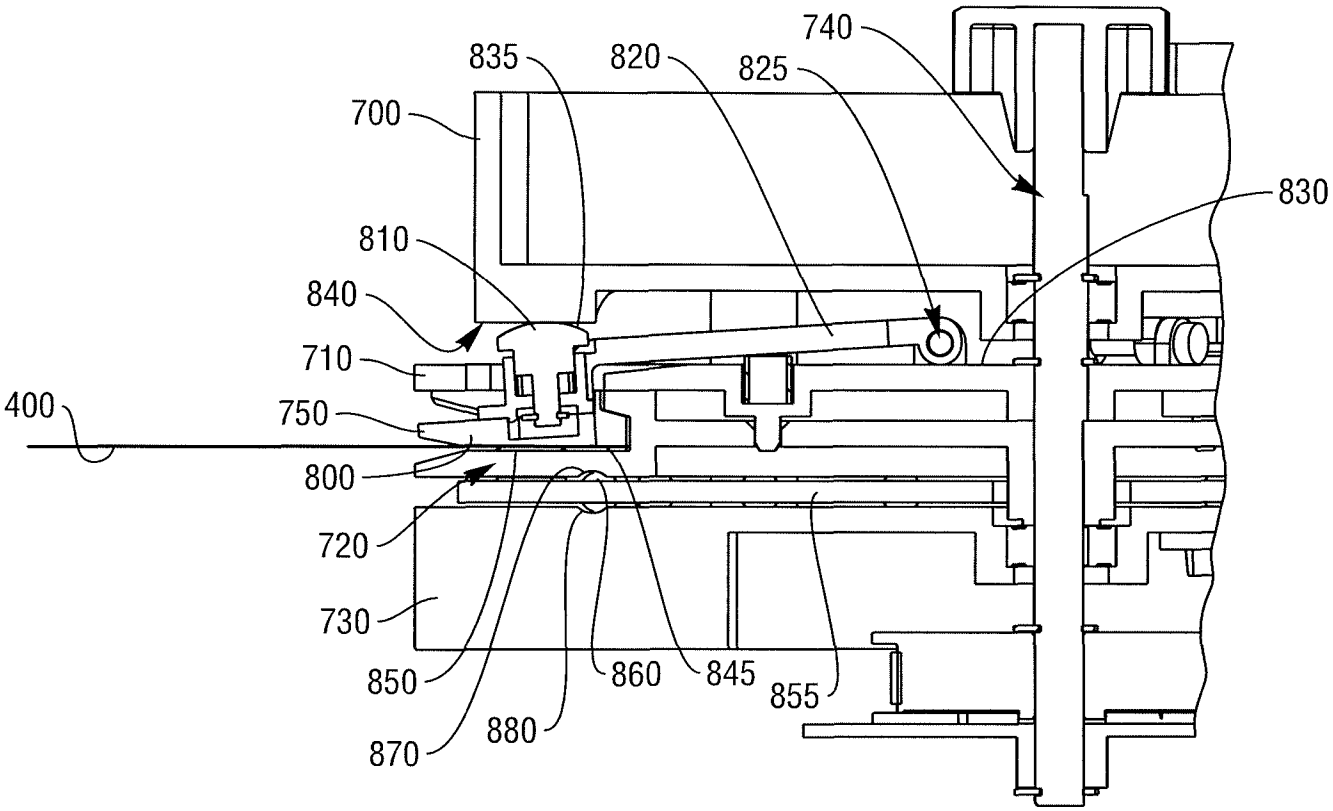
FIG. 8 illustrates clamping of an item of media to the turntable shown in FIG. 7.

FIG. 8 illustrates the clamping action in more detail. Each clamp 750 includes a clamping foot 800 which is secured to a plunger 810 and clamp arm 820. The foot 800, plunger 810 and arm 820 may be separate elements or may be integrally formed. The clamp arm 820 is pivotably secured about a pivot point 825 to a top surface 830 of the upper guide 710. The clamp is thus able to pivot up and down in a vertical direction about the pivot point 825. A top surface 835 of the plunger 810 is a convex abutment surface which rides on a downward facing cam surface 840 of the upper housing 700. The camming surface, which can be seen more clearly in FIG. 9, has a profile which extends downwardly with respect to a lower surface of the upper housing at one or more regions where items of media are to be clamped to the rotating elements of the re-orientation module 210. The currency notes 400 are secured by being squeezed between a lower surface 845 of the foot 800 of the clamp and a bumper 850 which is secured at a respective position to the lower guide 720.

A ball bearing retainer 855 which is a generally circular plate holding a multitude of ball bearings 860 in a substantially ring-like configuration helps ensure easy rotation of the various rotating elements of the re-orientation module 210. The ball bearings run in an upper race 870 on a lower surface of the lower guide and a lower race 880 in an upper surface of the base 730.

Figure 9:
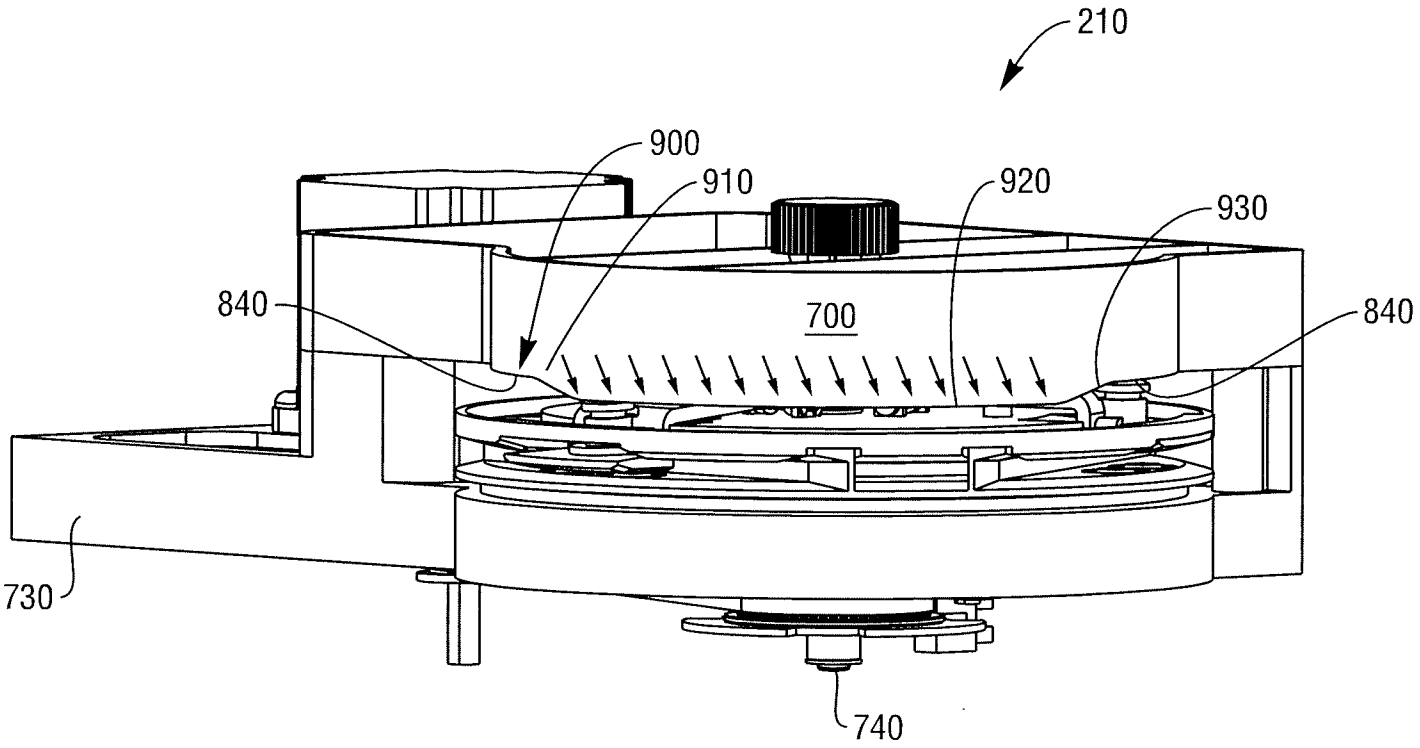
FIG. 9 illustrates a camming surface used to help clamp an item of media to the rotating turntable shown in FIG. 8.

FIG. 9 illustrates a further view of the re-orientation module 210 and, in particular, helps illustrate how a camming surface 840 which is utilized to press down on the plunger 810 of each clamp arm 820 is provided by the body of the upper housing 700. Each clamp arm is spring biased against the upper cam surface. In more detail, the lower surface 840 of the upper housing 700 is generally circular but from a recessed region 900 the lower surface 840 generally extends downwardly in an intermediate region 910 into a lower running region 920. As noted previously, the housing is fixed in place with respect to the guide surface 200 but as the drive shaft 740 is rotated the upper and lower guide plates 710, 720 carrying the clamps rotate with respect to the camming surface. The upper abutment surfaces of the plungers of each clamp ride on the camming surface 840 as the guide plates carrying the plungers rotate. In the recessed regions the clamps are biased away from opposed bumpers 880 carried on the lower guide. As the upper and lower guide elements rotate during the accelerating phase of rotation when an item of media is identified at the identification location 610, an abutment surface rides on the camming surface and begins to move downwardly in the intermediate region 910 of the camming surface. The steadily downwardly inclined and smooth camming surface thus generally presses the plunger downwardly thereby clamping any item of media between the plunger and an opposed bumper. The continued rotation of the upper and lower guides by driving the drive shaft 740 continues to rotate the upper and lower guides. Eventually, a further intermediate region 930 of the camming surface provides a transitional region in which a clamp plunger begins to lift away from an item of media. This releases the item of media. The camming surface in the housing then reaches the recessed region 840 which extends in a circular shape so that the abutment surfaces of plungers can continually ride on the camming surface ready for the next downward transition. The guide plates are decelerated and stopped once an item of media has been suitably released until the next item of media arrives.

Figure 10:
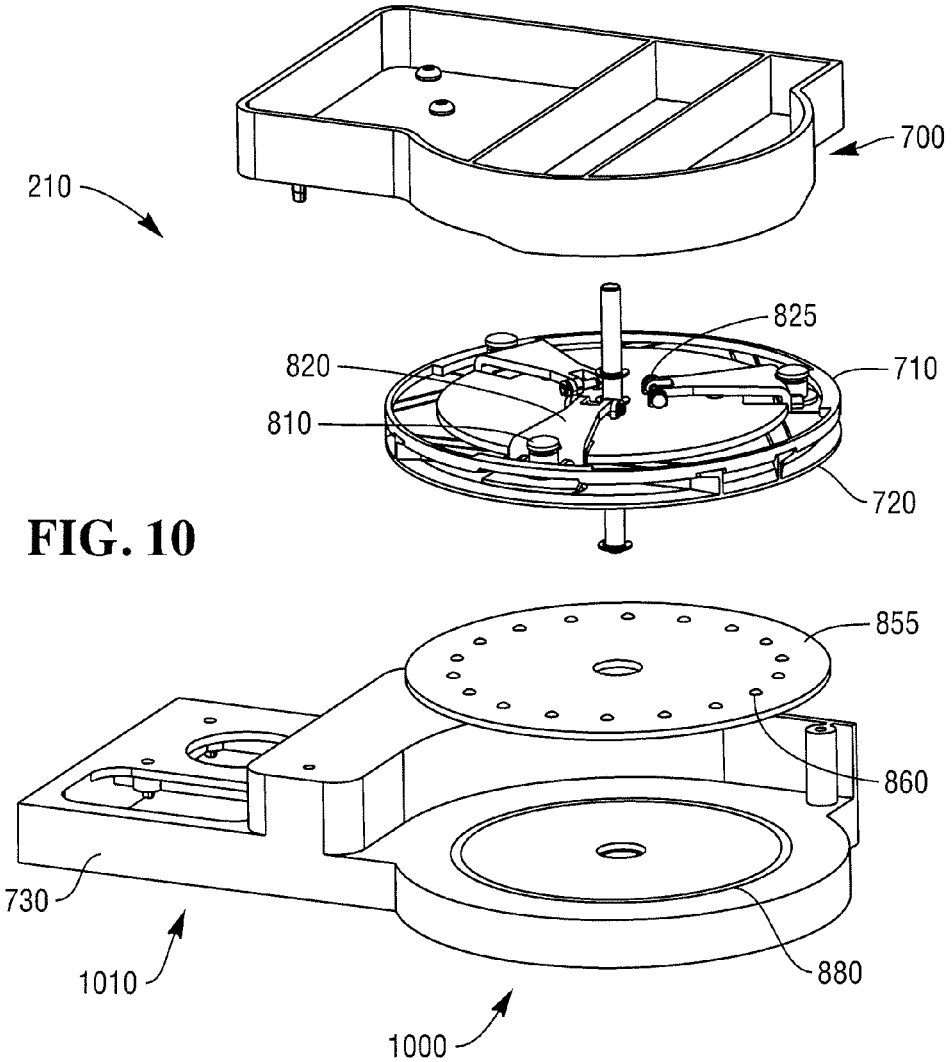
FIG. 10 illustrates an exploded view of the turntable.

FIG. 10 illustrates an exploded view of the re-orientation module 210 in more detail. The base 730 is a substantially rigid body having, at a first end 1000 thereof, a circular lower bearing race 880. A further end region 1010 of the base 730 is used to house a motor 855 and other parts of the re-orientation module 210. The ball bearing retainer which retains a ring of ball bearings 860 sits on the lower race 880 and the ball bearings 860 in the retainer 855 locate with an upper race 870 in a lower surface of the lower guide 720. Three clamps 820 are illustrated in FIG. 10 although the number of clamps can of course be selected according to need.

Figure 11:
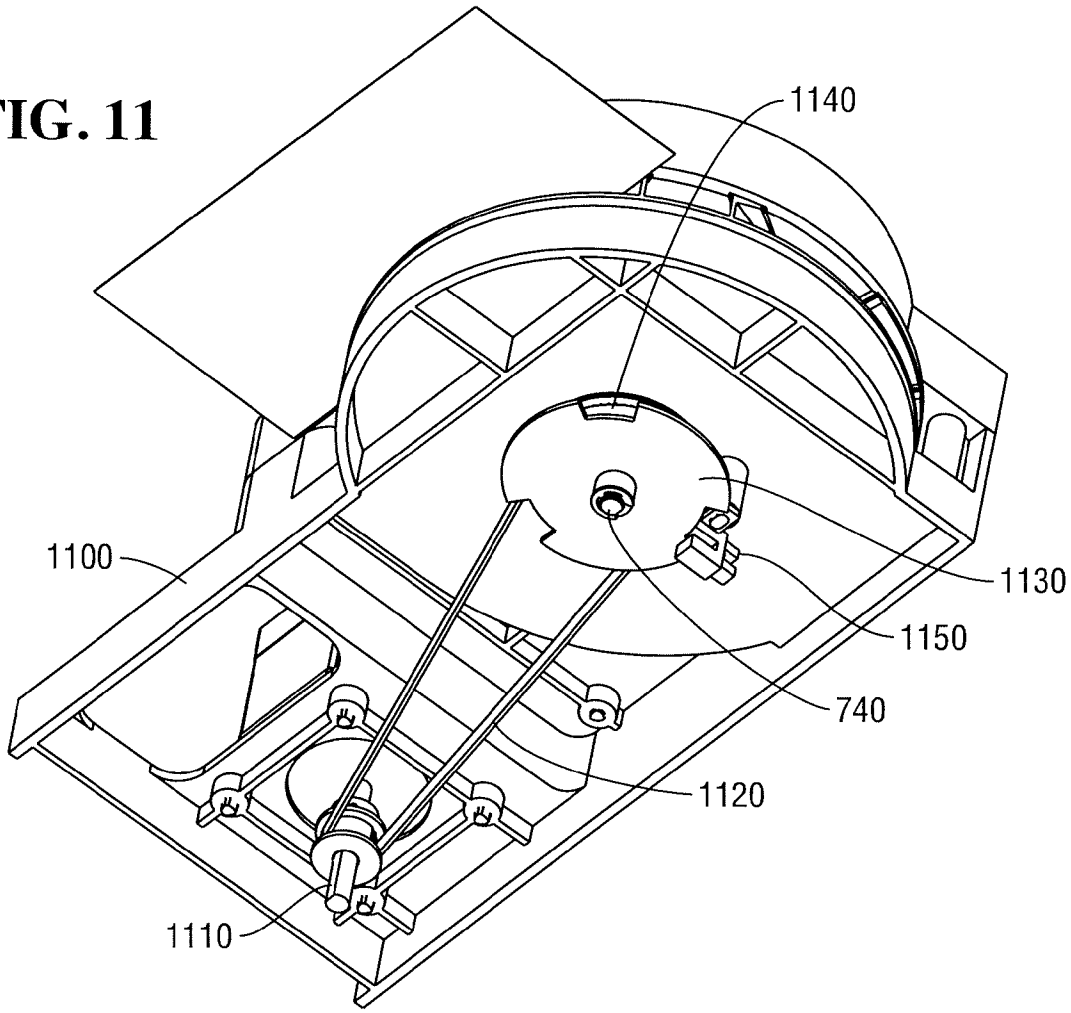
FIG. 11 illustrates an underside view of the turntable of FIG. 7 including a view of a drive mechanism for rotating the turntable.

FIG. 11 illustrates an underside of the re-orientation housing and illustrates how a stepper motor 1100 is used to drive a motor drive shaft 1110. This in turn drives a drive belt 1120 which is used to drive the drive shaft 740. A sensor plate 1130 is secured to a bottom end of the drive shaft 740. The sensor plate 1130 has three notches 1140 cut into it. Other detectable elements rather than notches could of course be utilized to mark a particular position. As the shaft 740 rotates these notches rotate and the position of the notches is sensed by a sensor 1150. The motor 1100 is a stepper motor and starts to rotate when an item of media arrives at a set point such as the identification position 610 when a next cycle is to begin. A partial revolution is then carried out to rotate the plunger of the clamp, which is clamping an item of media to the turntable-like mechanism, so that it rides over the length of the downwardly extending camming surface.

Certain embodiments of the present invention are usable in a deposit module. Such a module may optionally be incorporated in an SST such as an ATM.

Throughout the description and claims of this specification, the words "comprise" and "contain" and variations of them mean "including but not limited to" and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of the features and/or steps are mutually exclusive. The invention is not restricted to any details of any foregoing embodiments. The invention extends to any novel one, or novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. A deposit module configured for use in a self-service terminal (SST), comprising:

the deposit module adapted and configured to receive and transport currency as a media item within the SST and including:

a first region having a first axis of transport in which the media item is transported in a first orientation;

a further region having a further axis of transport in which the media item is transported in a further orientation different than the first orientation; and a validator adapted to validate the media item during transport;

wherein the further axis of transport associated with the further region is substantially parallel to and spaced apart from the first axis of transport associated with the first region; and a re-orientation device that (i) transports the media item between the first and further regions and (ii) rotates the media item between the first and further orientations;

wherein the re-orientation device comprises: a rotatable item guide rotatable by a drive shaft; and at least one clamping element that selectively clamps the media to move with the item guide, and automatically releases the media item from the item guide, as the item guide rotates to a pre-determined location in the further region.

2. The deposit module as claimed in claim 1, wherein the re-orientation device further comprises:

a housing comprising a cam surface; wherein the at least one clamping element comprises an abutment surface that engages with the cam surface to selectively clamp and release the media item at pre-determined locations as the clamping element rotates with respect to the cam surface.

3. The deposit module as claimed in claim 1, wherein the re-orientation device further comprises:

a base comprising a lower bearing race;

a retainer comprising a plurality of rollers; and an upper bearing race on a lower surface of the item guide.

4. The deposit module as claimed in claim 1, wherein the re-orientation device further comprises:

a drive belt that connects the drive shaft to a motor;

a timing disc carried on the drive shaft and comprising at least one detectable element; and at least one sensor that determines a location of each detectable element.

5. The deposit module as claimed in claim 1, further comprising:

a first roller that selectively drives an item of media along the first region towards or away from the re-orientation module.

6. The deposit module as claimed in claim 5, further comprising:

a solenoid that selectively locates said first roller in an engaged or disengaged mode of operation.

7. The deposit module as claimed in claim 5, further comprising:

a further roller that selectively drives an item of media along said further region towards or away from the re-orientation module.

8. The deposit module as claimed in claim 7, further comprising:

a solenoid that selectively locates said further roller in an engaged or disengaged mode of operation.

9. The deposit module as claimed in claim 1 wherein the transport path is bi-directional.

10. The deposit module as claimed in claim 1 wherein the first orientation is rotated substantially 90° with respect to the further orientation.

11. The deposit module as claimed in claim 1 wherein the SST is an Automated Teller Machine (ATM) and the media item is a currency note or check.

12. A method of re-orientating an item of media in a deposit module, comprising the steps of:

transporting, by the deposit module adapted to transport currency as an item of media, the item of media, in a first orientation with respect to a first axis of a first transport path, to a turntable;

rotating the turntable to re-orientate the item of media to a second orientation with respect to a second axis of a second transport path different than the first orientation with respect to the first axis while transporting the item of media to the second transport path;

wherein the second axis is non-contiguous with the first axis;

validating the item of media during transport; and transporting the item of media from the turntable along the second transport path in the second orientation.

* * * * *